US007878370B2

(12) United States Patent
Sevcik et al.

(10) Patent No.: US 7,878,370 B2
(45) Date of Patent: Feb. 1, 2011

(54) ALCOHOLIC BEVERAGE DISPENSER WITH ADDITIVE INJECTION

(76) Inventors: E. Scott Sevcik, 1802 Moorland La., Crystal Lake, IL (US) 60014; Kevin A. Brandt, 305-211 Devlin Rd., Ingleside, IL (US) 60041

( * ) Notice: Subject to any disclaimer, the term of this patent is extended or adjusted under 35 U.S.C. 154(b) by 845 days.

(21) Appl. No.: 11/663,018

(22) PCT Filed: Aug. 15, 2005

(86) PCT No.: PCT/US2005/029200

§ 371 (c)(1),
(2), (4) Date: Jun. 7, 2007

(87) PCT Pub. No.: WO2006/036353

PCT Pub. Date: Apr. 6, 2006

(65) Prior Publication Data

US 2009/0008407 A1 Jan. 8, 2009

Related U.S. Application Data

(60) Provisional application No. 60/612,127, filed on Sep. 22, 2004.

(51) Int. Cl.
*B67B 7/00* (2006.01)

(52) U.S. Cl. ..... 222/1; 222/129.1

(58) Field of Classification Search ..... 222/1, 222/129.1–129.4, 639–648, 52, 63
See application file for complete search history.

(56) References Cited

U.S. PATENT DOCUMENTS

| | | | | |
|---|---|---|---|---|
| 1,600,170 | A * | 9/1926 | Henderson | 222/129.1 |
| 3,460,717 | A | 8/1969 | Thomas | |
| 4,319,698 | A | 3/1982 | Tomiyama et al. | |
| 4,433,795 | A * | 2/1984 | Maiefski et al. | 222/14 |
| 4,708,266 | A * | 11/1987 | Rudick | 222/105 |
| 4,753,370 | A * | 6/1988 | Rudick | 222/105 |
| 5,642,761 | A * | 7/1997 | Holbrook | 141/104 |
| 5,803,320 | A | 9/1998 | Cutting et al. | |
| 5,960,997 | A | 10/1999 | Forsythe | |
| 5,967,367 | A | 10/1999 | Orsborn | |

* cited by examiner

*Primary Examiner*—Lien T Ngo
(74) *Attorney, Agent, or Firm*—Pyle & Piontek, LLC

(57) ABSTRACT

A system for introducing liquid additive into an alcoholic beverage is characterized by an alcoholic beverage dispensing faucet and at least one liquid additive delivery line routed between a supply of liquid additive and the faucet. Liquid additive may optionally, incident to dispensing alcoholic beverage and under control of a user of the faucet, be delivered through the at least one delivery line for introduction into the dispensed alcoholic beverage.

15 Claims, 4 Drawing Sheets

ALCOHOLIC BEVERAGE DISPENSER WITH ADDITIVE INJECTION

This application claims benefit of U.S. Provisional Application Ser. No. 60/612,127, filed Sep. 22, 2004.

TECHNICAL FIELD

The present invention relates to alcoholic beverage dispensers, and in particular to alcoholic beverage dispensing equipment that provides for introduction of additive fluids into alcoholic beverages.

BACKGROUND ART

The consumption of beer and alcoholic spirits is increasing in popularity. Spirits normally have an alcohol content or concentration greater, and often considerably greater, than that of beer.

A traditional method of dispensing draft beer is from one or more dedicated beer valves or faucets, each structured to dispense only a single brand of beer. It is known to include an additive in beer, such as green coloring for beer to be served on St. Patrick's Day. An additive can be included in beer supplied to a drink retailer, but that approach increases the number of kegs of beer the retailer must keep on hand. That approach also increases the number of beer faucets required to dispense beer, since a separate faucet must be provided for each type of beer, such as faucets for both colored and uncolored beer.

With increasing popularity of spirits consumption, the space required to stock different brands of spirits is demanding on the retailer. Both suppliers of brands and consumers desire new and creative ways to consume spirits. There are machines that chill spirits to temperatures below the freezing point of water, and due to their high alcohol content the spirits do not freeze and are served as super cooled or chilled shots to consumers. A traditional method of dispensing chilled shots uses a machine that dispenses one brand per faucet, and a new and creative way to provide chilled shots would be to include additives in brands supplied to a drink retailer. That approach, however, would increase the number of bottles of spirits the retailer must keep on hand and increase the number of spirit dispensing faucets required to dispense various different brands of spirits as chilled shots, since a separate faucet would have to be provided for each type of spirit to be dispensed.

It would be desirable to have a system for optionally and selectively introducing one or more additives into a basic draft beer brand or spirit brand dispensed from a single beer faucet.

OBJECT OF THE INVENTION

A primary object of the present invention is to provide a system for dispensing draft beer from a beer faucet and for optionally introducing a selected one or more additives into the beer.

DISCLOSURE OF THE INVENTION

The invention provides an improved alcoholic beverage dispensing system of a type having an alcoholic beverage dispensing faucet fluid coupled to a supply of alcoholic beverage. The improvement comprises inclusion in the system of a flow line for fluid coupling at an inlet thereto to a supply of liquid additive and terminating at an outlet therefrom at the faucet; and delivery means optionally operable by a user of the faucet to deliver liquid additive from the supply thereof through the flow line for emission from the outlet from the flow line and introduction to alcoholic beverage dispensed from the faucet.

The invention also provides an improved method of dispensing alcoholic beverage from a faucet fluid coupled to a supply of alcoholic beverage, which comprises the steps of fluid coupling an inlet to a flow line to a supply of liquid additive; positioning an outlet from the flow line at the faucet; dispensing alcoholic beverage from the faucet; and optionally delivering through the flow line, incident to performance of the dispensing step, liquid additive from the supply thereof for emission from the outlet from the flow line and introduction to dispensed alcoholic beverage.

BEST MODE FOR CARRYING OUT THE INVENTION

The invention is concerned with a system and method that can be used to dispense alcoholic beverages such as beer and chilled alcoholic spirits, and in particular to a system and method for optionally introducing additives to such alcoholic beverages when the beverages are dispensed. For convenience and brevity, the invention will be described primarily with reference to the introduction of additives to dispensed beer. It is understood, however, that the teachings concerning the system and method also apply to the introduction of additives to dispensed chilled spirits.

Figure 1:
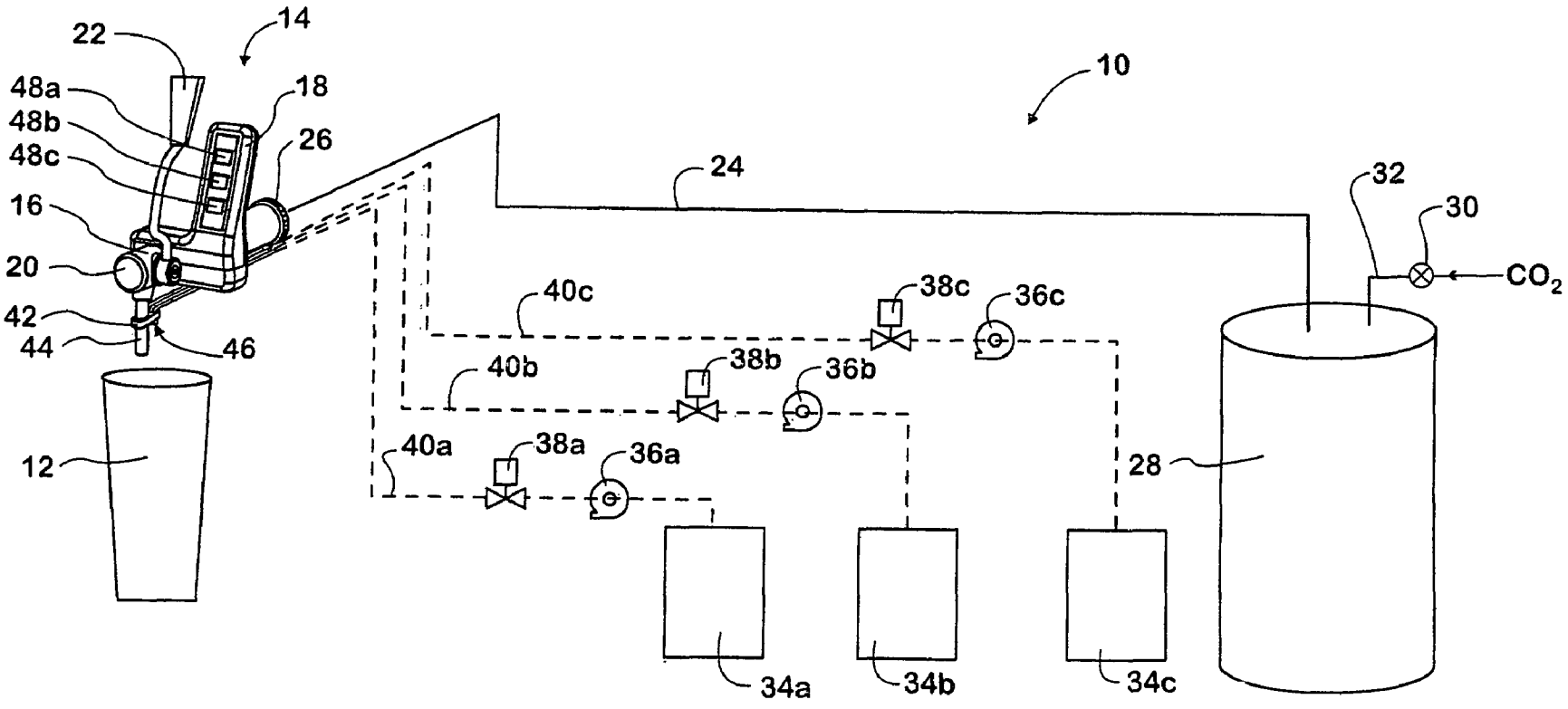
FIG. 1 shows a system for dispensing alcoholic beverage into a container and for optionally introducing one or more additives to the dispensed beverage.

Considering the invention in connection with the dispensing of beer, there is shown in FIG. 1 and indicated generally at 10 a system for dispensing draft beer into a container 12 and for optionally introducing or adding one or more liquid additives to dispensed beer. The additives can be flavors such as raspberry, lime, lemon, etc., they can be health enhancements such as vitamins or minerals, they can be drink appearance attributes such as colors and dyes, they can be temperature changing attributes such as menthol, or they can be other types of additives that suitably lend themselves to being added to beer.

Figure 2:
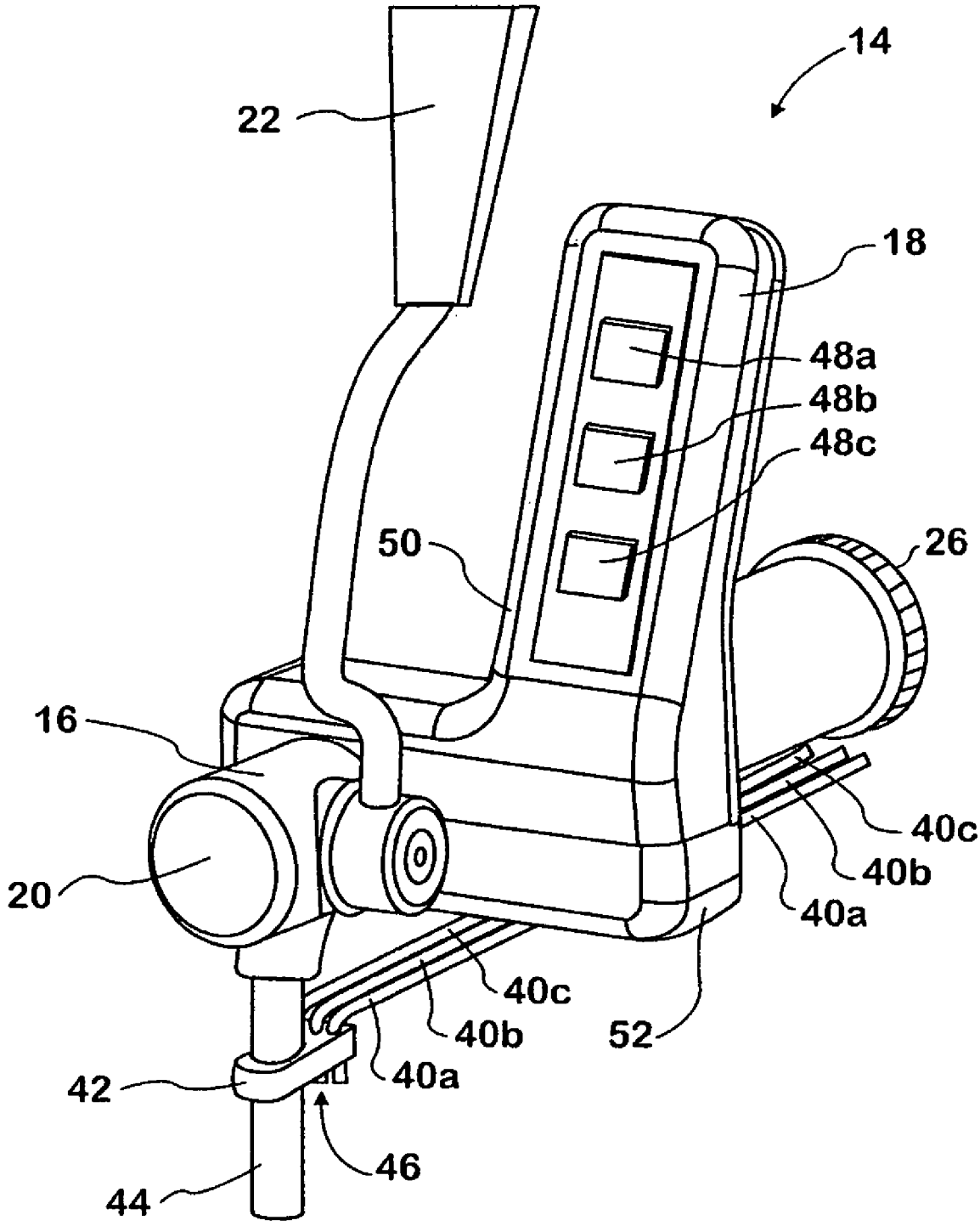
FIG. 2 shows an alcoholic beverage dispensing faucet and a control interface for selective introduction of one or more additives to dispensed beverages.
Figure 3:
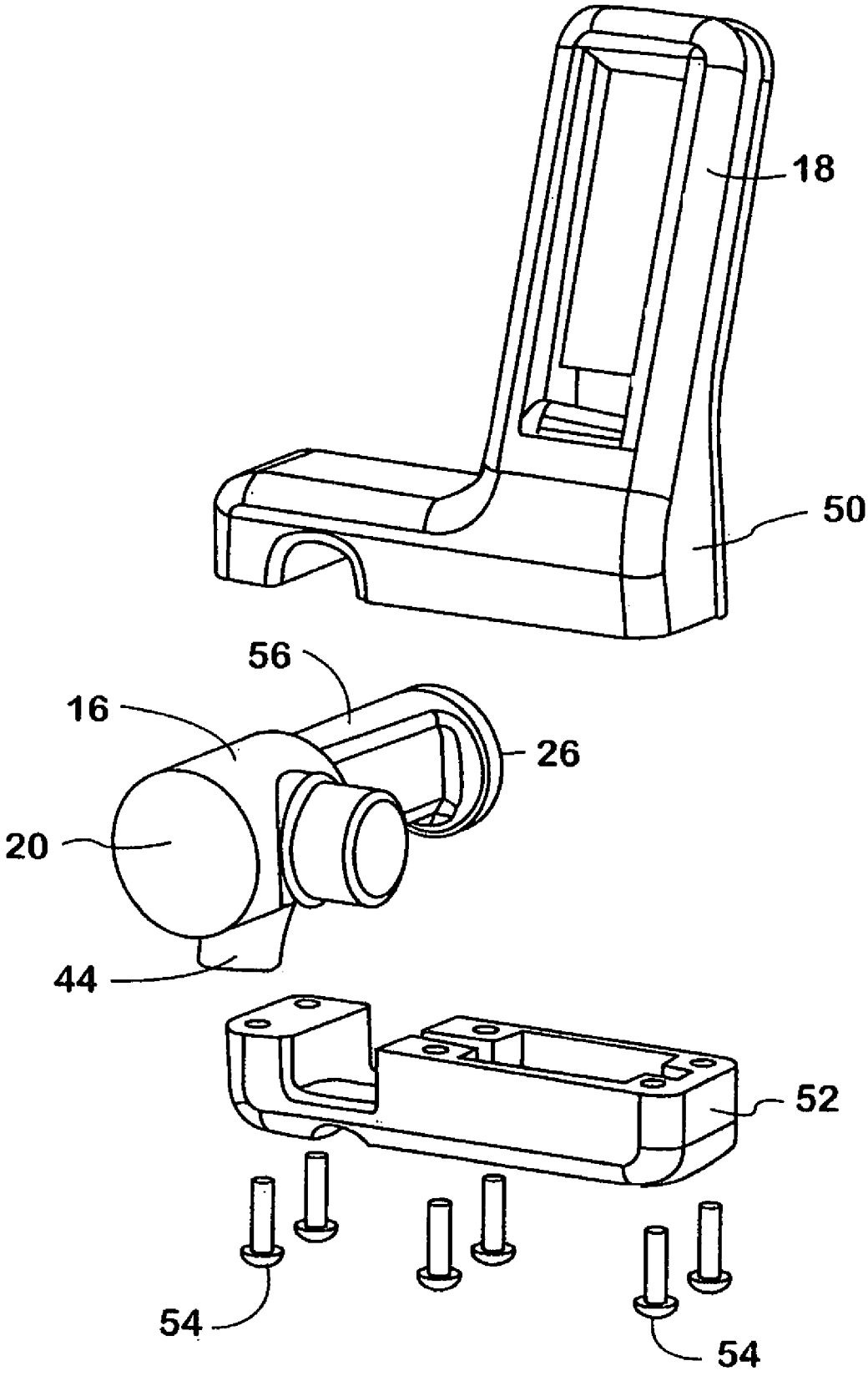
FIG. 3 shows an exploded assembly view of the FIG. 2 dispensing station.

Referring also to FIGS. 2 and 3, the system 10 includes a beer and additive dispensing station indicated generally at 14 and consisting of a beer dispensing or pouring faucet 16 and a control interface 18 by which a user can initiate introduction of liquid additive to dispensed beer. Beer faucet 16 may be of conventional design and includes a valve 20 that is manually operated between open and closed states by an operator movable handle 22 to dispense beer delivered to the faucet through a line 24 extending between an inlet 26 to the faucet and a container 28 of draft beer, such as a keg of draft beer. To assist in propelling beer from container 28 to the faucet, a source of $CO_2$ is coupled through a pressure regulator 30 and a line 32 to an inlet to the container.

Except for the control interface 18, to the extent described the system 10 is generally conventional. In improving upon such a conventional beer dispensing system, the invention provides the ability for a user to optionally introduce a selected one or more liquid additives to dispensed beer. In the illustrated embodiment, provision is made for introducing a selected one or more of three additives to beer dispensed into container 12, which additives may comprise three different liquid flavors and may, as is understood, comprise less than or more than three additives. The additive flavors are supplied in containers 34*a*, 34*b* and 34*c* that may be bag in box type containers of concentrate flavors. To deliver the flavors from containers 34*a*, 34*b* and 34*c* to dispensing station 14, an outlet from each container is coupled to an inlet to an associated metering pump 36*a*, 36*b* and 36*c*, which pumps may be positive displacement metering pumps, such as gear pumps, or may be any other suitable type of pump that provides a metering function by being energized for selected periods of time. An outlet from each pump is coupled to an inlet to an associated solenoid controlled valve 38*a*, 38*b* and 38*c*, outlets from which valves fluid couple through associated liquid additive delivery tubes or lines 40*a*, 40*b* and 40*c* to dispensing station 14. At the dispensing station, the liquid additive delivery lines are routed under control interface 18 to a bracket 42 carried by an outlet nozzle 44 of beer faucet 16. The bracket supports outer ends of the lines 40*a*, 40*b* and 40*c*, such that outlets from the lines are oriented to direct liquid additive downward from an additive dispense point 46 into container 12 and beer dispensed into the container. Although for the arrangement shown liquid additives are directed downward into the container, the outlets from the additive delivery lines could be oriented to direct additives into a stream of beer flowing from nozzle 44 into the container.

The control interface 18 carries a keypad 34 having a plurality of push-button switches 48*a*, 48*b* and 48*c* that are optionally actuated by a user of the beer dispense faucet 16, incident to dispensing beer, to introduce one or more additives into dispensed beer by controlling operation of respective metering pumps 36*a*, 36*b* and 36*c* and solenoid controlled valves 38*a*, 38*b* and 38*c* to deliver to dispensing station 14 a selected one or more liquid flavors from containers 34*a*, 34*b* and 34*c*. For example, if liquid flavor 1 from container 34*a* is to be added to beer dispensed from faucet 16 into container 12, switch 48*a* is actuated cause valve 38*a* to open and pump 36*a* to operate for a selected time to deliver a predetermined metered quantity of flavor 1 from flavor container 34*a* through pump 36*a*, valve 38*a* and line 40*a* to the outlet from the line at dispensing point 46. Flavor 1 emitted from line 40*a* outlet is then directed toward and into container 12 for mixing with beer dispensed into the container, although flavor 1 could, if desired, instead be directed into the stream of beer flowing from nozzle 44 into the container. Opening of valve 38*a* and operation of pump 36*a* can occur either before, during or after dispensing of beer, with subsequent closure of the valve preventing dripping of flavor 1 from the outlet from delivery line 40*a*. If desired, more than one switch 48*a*, 48*b* and 48*c* can be actuated incident to beer dispense to introduce more than one flavor into the beer. Electronic circuitry responsive to actuation of the switches 48*a*, 48*b* and 48*c* to operate pumps 36*a*, 36*b* and 36*c* and valves 38*a*, 38*b* and 38*c* will be described below in connection with FIG. 4.

As seen in FIGS. 2 and 3, a conventional beer dispensing faucet 16 may readily be retrofit to embody the invention, thereby to provide retail outlets the ability to add flavors to existing brands of beer. For the purpose, control interface 18 may comprise an upper housing portion 50 and a lower housing portion 52 on upper and lower sides of beer faucet 16, which housing portions are joined together by a plurality of fasteners 54 to capture therebetween an inlet extension 56 of the beer faucet and mount the control interface on the faucet. Mounting control interface 18 on beer faucet 16 makes its push-button switches 48*a*, 48*b* and 48*c* readily available for single-handed actuation by a user incident to dispensing beer. Alternatively, the control interface could be provided as part of faucet handle 22.

Figure 4:
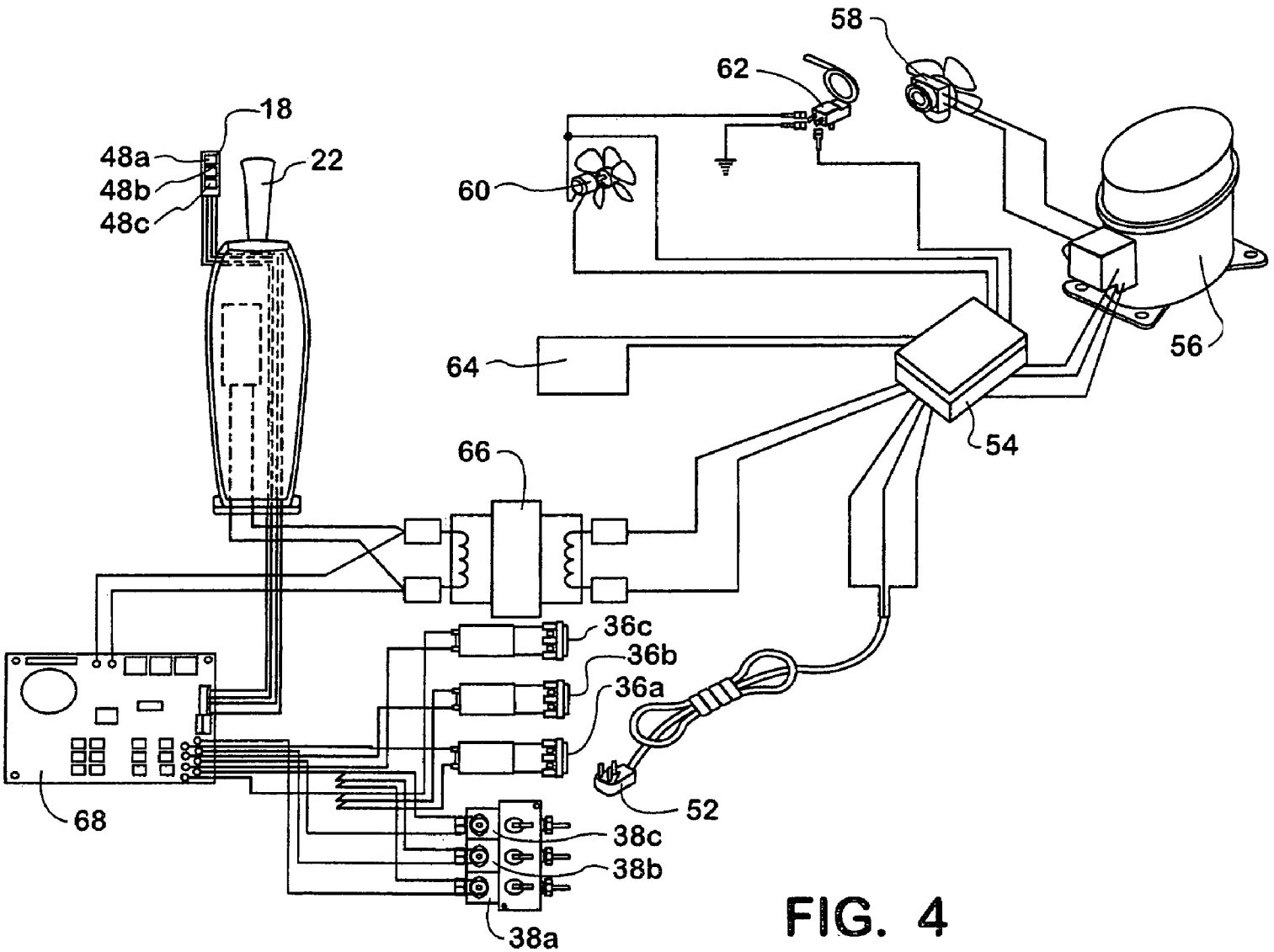
FIG. 4 is a pictorial wiring diagram of the system.

Referring to FIG. 4, an electronic circuit of system 10 includes a power cord 52 for delivery of operating voltage to a junction box 54 that distributes the voltage to various system components. The container of beer 28 is normally maintained in a refrigerated cabinet at a temperature above the freeing point of water, and voltage is delivered from junction box 54 to a compressor 56, a condenser fan motor 58, an evaporator fan motor 60, a thermostat 62 and a door seal heater wire 64 of the cabinet, which components operate in a well understood manner to chill the interior of the cabinet to keep the container of beer cold. Voltage also is routed from junction box 54 to a primary side of a step-down transformer 66, a secondary side of which delivers a reduced voltage to metering pumps 36*a*, 36*b* and 36*c*, to solenoids of the solenoid controlled valves 38*a*, 38*b* and 38*c*, and to switches 48*a*, 48*b* and 48*c* of control interface 18. The reduced voltage also is delivered to a logic circuit board 68 that is electrically coupled to the switches 48*a*, 48*b* and 48*c*, solenoid controlled valves 38*a*, 38*b* and 38*c*, and metering pumps 36*a*, 36*b* and 36*c* to operate the solenoid controlled valves and metering pumps in response to actuation of the switches. The logic circuit can be programmed to operate the metering pumps and solenoid controlled valves, to thereby control the amount of additive(s) dispensed, for periods of time in accordance with the size of drink dispensed or manually for times controlled by continued actuation of one or more switches.

While the system and method of the invention have been fully described in connection with dispensing of beer it is, as previously stated, contemplated that such a system and method be used to dispense chilled alcoholic spirits, particularly super cooled or chilled shots of spirits, to which one or more additives may optionally be introduced. In this case, container 28, instead of comprising a keg of beer, would be a container of an alcoholic spirit, the refrigeration system would be adjusted to cool the spirit in the container to a temperature below the freezing point of water, but not so cold as to freeze the alcoholic spirit, and faucet 16 would be for dispensing the chilled alcoholic spirit. In all other respects the system and method would operate and perform as described in connection with dispensing beer, except that chilled shots of spirits would be dispensed, to which one or more additives may optionally be introduced.

While only one alcoholic beverage (i.e., a draft beer brand or chilled spirit brand) is dispensed per faucet 16, the invention provides the ability to optionally introduce into dispensed alcoholic beverages a selected one or more liquid additives, so that a single brand of alcoholic beverage can be extended into a multitude of combinations at a single dispensing station. The additives can be flavors, health enhancements or any other product that lends itself to addition to such alcoholic beverages, and can be selected via control interface 18 prior to, during or after alcoholic beverage dispense for introduction to the beverage. The concentration of the flavor is chosen to be such that the flavor shot has sufficient strength to completely flavor the entire alcoholic beverage, and either manually or through electronic control the flavor shot volume may be regulated based upon the size of the alcoholic beverage dispensed.

It also understood that while the invention has been described in connection with three different additives, a lesser or greater number of additives can be dispensed at a single alcoholic beverage dispensing station 14. Since additives can be dispensed individually or simultaneously, control interface 18 and its keypad switches 48*a*, 48*b* and 48*c* allow the user to create unique profiled flavored alcoholic beverages. The keypad buttons desirably are illuminated to visualize additive choices and the stages of the alcoholic beverage dispense process. The additive circuits comprising pumps 36*a*, 36*b* and 36*c*, valves 38*a*, 38*b* and 38*c* and lines 40*a*, 40*b* and 40*c* transition the additives from storage containers 34*a*, 34*b* and 34*c* and distribute the additives to localized dispense point 46. The dispense point is near dispense faucet outlet nozzle 44 and outlet ends of flavor conveying lines 40*a*, 40*b* and 40*c* are secured by bracket 42 to faucet nozzle 44 at the dispense point, so that the lines are proximate to, aligned with and behind the faucet nozzle and are not generally visible from the front of the dispensing station. If desired, the lines can be integrated into the faucet design or the design of a tower supporting the faucet.

The additives are highly concentrated and each is stored and routed independent of the basic alcoholic beverage product and other additives. The additives are such as to not alter the body of the beer, but only to compliment it. The additive concentrates are desirably sufficiently concentrated that they allow for a beer/additive ratio that may be on the order of 1000:1 to a more conventional 5:1 ratio, more or less, which allows for storage of smaller quantities of additives, decreased distribution costs and less impact on the color and body of the basic brand alcoholic beverage. The additive concentrates can be clear, so as not to change the visible appearance of the alcoholic beverage, or they can be colored to create unique appearance attributes, such as green for Saint Patrick's day.

Alcoholic beverage dispensing faucet 16, additive selection control interface 18 and outlets from flavor lines 40*a*, 40*b* and 40*c* are all located at the dispense station, so a user does not have to relocate container 12 to introduce additive to the dispensed alcoholic beverage. Additive supplies 34*a*, 34*b* and 34*c*, pumps 36*a*, 36*b* and 36*c* and valves 38*a*, 38*b* and 38*c*, on the other hand, may be mounted in the most convenient location, which normally is near container 28 or under a counter. The additive lines 40*a*, 40*b* and 40*c* may be small stainless steel tubes and the pumps advantageously are positive displacement devices, such as gear pumps which, when actuated for a known time, dispense a predetermined volume of additive, so that the correct volume of additive can be precisely dispensed into an alcoholic beverage of known size.

The invention claimed is:

1. A beverage dispensing system, comprising:

a beverage dispensing faucet;

first means for fluid coupling said faucet to a supply of beverage;

first delivery means manually actuable between a first state flowing beverage from the supply thereof to and through a beverage outlet from said faucet and a second state interrupting the flow;

second means including a flow path for fluid coupling said faucet to a supply of liquid additive; and second delivery means manually actuable, independent of any actuation of said first delivery means, between a first state flowing liquid additive from the supply thereof through said flow path to and through an outlet from said flow path at said faucet and a second state interrupting the flow, whereby actuation of said second delivery means to its first state and flow of liquid additive through said flow path can occur before, during or after actuation of said first delivery means to its first state and, therefore, before, during or after flow of beverage from said faucet beverage outlet;

wherein said second delivery means includes a metering pump for delivering metered quantities of liquid additive through said flow path in accordance with the time for which said second delivery means is manually actuated, and a valve for opening and closing said flow path.

2. A system according to claim 1, wherein said flow path comprises a plurality of flow paths, each for fluid coupling said faucet to an associated one of a plurality of supplies of liquid additives, and said second delivery means is manually actuable, independent of any actuation of said first delivery means, to deliver liquid additive from a selected one or more supplies thereof through the associated one or more flow paths for emission from the outlet from each of the one or more flow paths and introduction to beverage dispensed from said faucet only while and for as long as said second delivery means is manually actuated.

3. A system according to claim 1, including control means for opening said valve and actuating said pump to flow liquid additive through said flow path for emission from said flow path outlet while and for as long as said second delivery means is manually actuated and for closing said valve and de-actuating said pump to interrupt flow of liquid additive through said flow path when said second delivery means is not manually actuated, said valve when closed preventing dripping of liquid additive from said flow path outlet.

4. A system according to claim 1, wherein said second delivery means includes switch means at said faucet for actuation by the user to initiate delivery of liquid additive through said flow path.

5. A system according to claim 4, wherein said switch means is mounted to said faucet.

6. A system according to claim 1, wherein said flow path includes tubing that is mounted to said faucet toward said flow path outlet.

7. A system according to claim 1, wherein said flow path outlet is oriented to direct liquid additive into a container into which beverage from said faucet is dispensed.

8. A system according to claim 1, wherein said flow path outlet is oriented to direct liquid additive into a stream of beverage dispensed from said faucet.

9. A method of dispensing beverage, comprising the steps of:

fluid coupling a beverage dispensing faucet to a supply of beverage through a first valve;

manually actuating the first valve between a first state flowing beverage from the supply thereof to and through a beverage outlet from the faucet and a second state interrupting the flow;

fluid coupling a flow path to a supply of liquid additive through a second valve; and manually actuating the second valve, independent of any actuation of the first valve, between a first state flowing liquid additive through the flow path to and through an outlet from the flow path at the faucet and a second state interrupting the flow, whereby actuation of the second valve to its first state and flow of liquid additive through the flow path can occur before, during or after actuation of the first valve to its first state and, therefore, before during or after flow of beverage from the beverage outlet from the faucet, including the steps of fluid coupling a metering pump in the flow path and operating the metering pump to deliver liquid additive through the flow path during performance of said step of manually actuating the second valve to its first state.

10. A method according to claim 9, wherein said step of fluid coupling a flow path to a supply of liquid additive through a second valve comprises fluid coupling a plurality of flow paths to associated ones of a plurality of supplies of liquid additives through associated ones of a plurality of second valves and said step of manually actuating the second valve comprises manually actuating a selected one of the plurality of second valves to its first state to flow liquid additive from its associated supply through its associated flow path to and through an outlet from the associated flow path at the faucet.

11. A method according to claim 9, wherein said step of manually actuating the second valve to its first state includes the step of delivering a metered amount of additive through the flow path.

12. A method according to claim 9, wherein said step of manually actuating the second valve includes the step of manually actuating a switch at the faucet.

13. A method according to claim 9, including the step of mounting the outlet end of the flow path to the faucet.

14. A method according to claim 9, including the step of orienting the outlet from the flow path to direct liquid additive into a container into which beverage from the faucet is dispensed.

15. A method according to claim 9, including the step of orienting the outlet from the flow path to direct liquid additive into a stream of beverage dispensed from the outlet from the faucet.

* * * * *